United States Patent [19]

Winkler et al.

[11] 4,397,686

[45] Aug. 9, 1983

[54] METHOD FOR REFINING PRECIOUS METALS

[76] Inventors: Louis T. Winkler, 1308 SE. 1st Ave., Deerfield Beach, Fla. 33441; John D. Goins, 2211 SW. 27 Ter., Miami, Fla. 33133; George R. St. Pierre, 3595 Olentangy Blvd., Columbus, Ohio 43214; Carroll E. Mobley, 2753 Cranford Rd., Columbus, Ohio 43221; Craig B. Shumaker, 148 W. Dominion Blvd., Columbus, Ohio 43214

[21] Appl. No.: 224,163

[22] Filed: Jan. 12, 1981

[51] Int. Cl.[3] ..... C22B 11/00

[52] U.S. Cl. ..... 75/63; 75/83

[58] Field of Search ..... 75/83, 79, 63

[56] References Cited

U.S. PATENT DOCUMENTS

| | | | |
|---|---|---|---|
| 3,892,562 | 7/1975 | Miller | 75/83 |
| 3,902,890 | 9/1975 | Sarmiya et al. | 75/83 |
| 4,029,494 | 6/1977 | Kapanen et al. | 75/83 |

*Primary Examiner*—M. J. Andrews

*Attorney, Agent, or Firm*—Eugene F. Malin

[57] ABSTRACT

A method for economically removing base metal impurities, other oxidizable impurities, and volatile impurities from precious-metal-bearing metallic materials, consisting of silver and gold, to obtain, with high recovery, a resultant precious metal of high purity (more than 99.9%) that greatly reduces refining time and precious metal loss in recovery. The method includes the steps of (1) controlled heating to maintain a temperature slightly above the melting temperature of the molten metallic mass, (2) maintaining contact between an oxidizing agent and the metallic mass to provide a concentration of dissolved oxygen within the molten metal throughout the refining process, (3) maintaining a flux medium on the surface of the molten material that absorbs base metal and other impurity oxides, and (4) controlling the concentration of base metal and other impurity oxides in the flux to a level that ensures continued transfer of the base metal oxides into the flux medium. The oxidizing agent, which is continuously absorbed into solution in the molten precious metal, combines with base metal impurities such as copper, zinc, iron or lead, and other oxidizable impurities to form oxides which are absorbed in the molten flux floating on the metallic surface. The concentration of base metal oxides is controlled in one embodiment in the flux medium through sequential treatments in which flux is applied and then removed after an appropriate amount of time. The amount of precious metal, and its purity recovered is greatly enhanced. Each flux increment is reused in a subsequent batch at a prior sequential stage of refinement.

24 Claims, 4 Drawing Figures

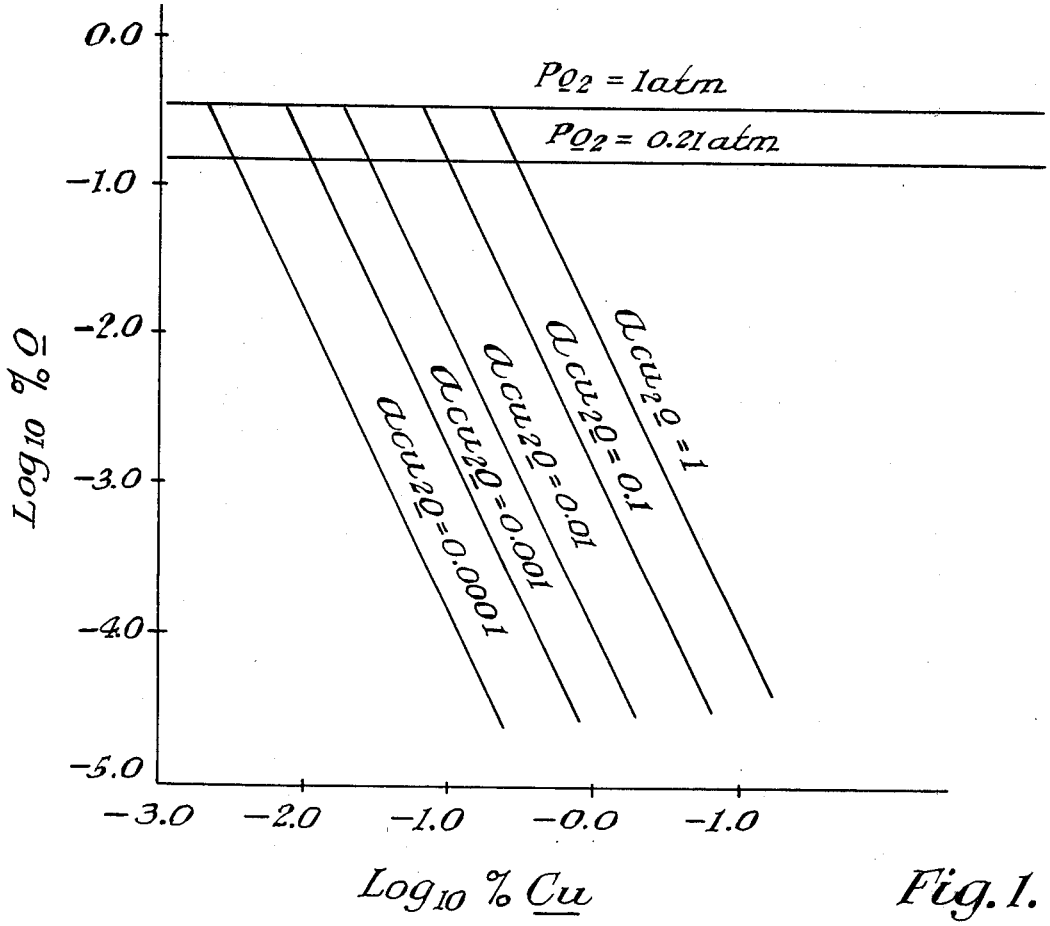
Fig. 1.
The Equilibrium Oxygen Content in silver as a Function of Copper Content at 1234°K.
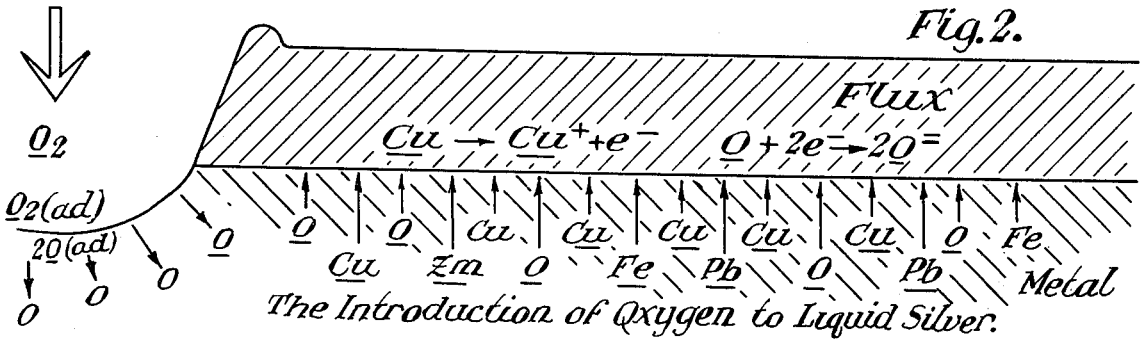
The Metal-Oxygen Reaction Mechanism.

Fig. 3.

Flux-metal Interface $\underline{O}$ (in solution) $\xrightarrow[\text{Diffusion \& Mixing.}]{\text{Transport}}$ $\overbrace{\underline{O} + 2e^- \text{—} \underline{O}^=}$ $\xrightarrow[\text{Diffusion \& Mixing}]{\text{Desorption}}$ $\underline{O}^=$ (Flux)

$Cu$ (in solution) $\longrightarrow Cu \rightarrow Cu^+ + e^- \longrightarrow Cu^+$ (Flux)

$Pb$ (in solution) $\longrightarrow Pb \rightarrow Pb^{++} + 2e \longrightarrow Pb^{++}$ (Flux)

$Fe$ (in solution) $\longrightarrow Fe \rightarrow Fe^{++} + 2e \longrightarrow Fe^{++}$ (Flux)

$Zn$ (in solution) $\longrightarrow Zn \rightarrow Zn^{++} + 2e \longrightarrow Zn^{++}$ (Flux)

etc.

$Ag$ (also possible) $\underline{Ag} \rightarrow Ag^+ + e^- \longrightarrow Ag^+$ (Flux)

Order of Oxidation of the above metals: Zn, Fe, Pb, Cu, Ag.

Fig. 4.

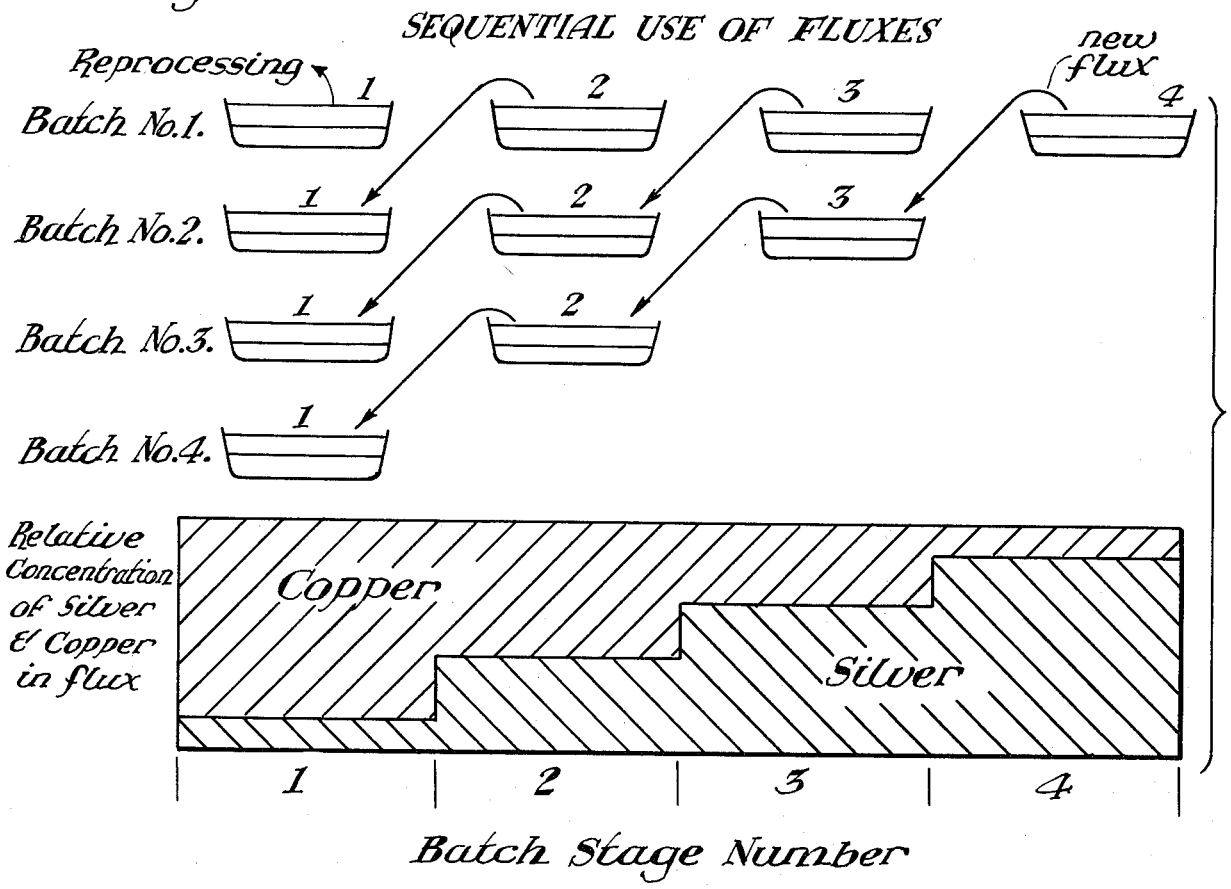

METHOD FOR REFINING PRECIOUS METALS

BACKGROUND OF THE INVENTION

This invention relates to the refinement of high quality precious metals and consisting of silver and gold from ore or scrap or other such precious metal-bearing metallic materials that effectively and quickly removes base metals such as copper, zinc, iron or lead to produce a high quality bullion containing more than 99.9% of such precious metal, while enhancing the overall amount of such recovered precious metal.

Since the discovery and introduction of gold and silver, into society, man has constantly sought ways of increasing the efficiency of refining techniques which includes reducing the refining time without diminishment of purity levels, while increasing the amount of recovered metal. The escalation in value (price per ounce) of silver and gold in recent years, intensifies the need for an efficient refining process for precious metals having a low turnaround time at the refinery. Since gold and silver often form the basis of currencies, each day of processing time can represent substantial monetary losses to the owner of the precious metal-bearing materials. Unrecoverable precious metal lost in refining also represents a substantial economic loss. Other considerations, especially environmental, add additional costs to refining. Finally increased energy costs also result in increased refining costs.

In spite of the recent events and problems with respect to the spiraling costs of refining high quality (99.5%) precious metals, present day commercial refining of silver and gold employs electrolytic refining techniques (used for over half a century). The primary deficiencies with electrolytic refining of precious metals is that it (1) results in high losses of the precious metal during refinement that cannot be recovered; (2) requires the use of acids which increase handling and disposal problems and costs; (3) introduces acidic and corrosive fumes during the refining process which require fume control techniques such as venting and the like; (4) consumes large amounts of energy and requires costly equipment; and (5) presents unnecessary health hazards for employees.

Methods of refining precious metals disclosed in the prior art clearly document the problems discussed above. In U.S. Pat. No. 1,004,576 issued to Neilly, Oct. 3, 1911, a process is described for refining silver that includes first making a "speiss" which introduces more base metals, and concludes with an air blast technique, the entire process consuming a long time period. In U.S. Pat. No. 3,902,890, a method is employed for refining silver-bearing residues that includes three successive furnace processes, low purity levels (86%) and is very slow (30 hours per batch). In Kapanen et al, U.S. Pat. No. 4,029,494, a method of recovering noble metals is employed that requires a long time period and additional refining to obtain bullion quality.

The present invention provides a method of obtaining high quality (bullion) silver or gold using a pyrotechnical refining process that greatly reduces refining time and high loss of material, eliminates the handling and disposal problems of acids and fume control and reduces the energy costs and complex equipment required.

SUMMARY OF THE INVENTION

A process for efficiently refining silver or other precious metals from precious-metal-bearing metallic materials at a high degree of purity (above 99.5%) comprising the steps of (1) melting the silver-bearing material above a predetermined temperature to form a moldten mass, (2) subjecting the molten silver-bearing material with an oxidizing agent to continuously maintain an over potential of oxidizing agents throughout the molten material and especially at the interface of the molten material, (3) establishing a liquid flux layer (less dense than the molten material) on the surface of the molten material that attracts base metal and other impurity oxides across the flux-metal interface of the molten material into the flux, (4) controlling the concentration of the impurity oxides and especially the base metal oxides in the flux below the level required to ensure base metal oxide migration, and (5) reusing the flux in subsequent batches in an earlier treatment stage to enhance the recovery of the precious metals.

Additional steps may be included to enhance the finished product and reduce the refining time. For example, a preliminary step may include subjecting a silver-bearing metallic material to an oxidizing environment during the initial meltdown. This accelerates the oxidation of the molten material with the oxidizing agent.

BRIEF DESCRIPTION OF THE DRAWINGS

FIG. 1 is a graph of percentage O to percentage Cu.

FIG. 2 is an illustration of the principles involved in the process.

FIG. 3 is an illustration of the chemical reaction in the process.

FIG. 4 is an illustration of the flow of reused flux in batches.

In one preferred embodiment of the invention, after meltdown, the molten material is transferred to a shallow tray. The oxidizing agent such as air or oxygen is continuously introduced throughout the refining process at numerous locations onto the upper surface of the molten material in the tray through a plurality of nozzles disposed above the tray which cause streams of oxidizing gas to directly impinge on the surface of the molten material at selected locations. This ensures that a potential of the oxidizing agent is maintained throughout the molten material, especially at the flux-metal interface at all times. Silver readily absorbs the oxygen into the molten material throughout the oxidizing process.

A suitable flux consisting of silica, soda ash, and anhydrous sodium tetraborate is introduced on the surface which, at the operating temperatures described, forms a liquid layer on the molten material. The numerous air streams are of such force that they readily and continuously permeate the flux layer, clearing a small surface area under each nozzle for the continuous introduction of oxygen directly into the molten material. The force of the gas jets also cause a stirring effect on the molten material, which is described in more detail below.

The flux applied must be of such a nature that it remains a liquid at and above the melting point of the molten precious-metal-bearing material (e.g. in the case of silver, approximately 961° C.) and is selected to have other essential properties which include chemical stability; resistance to disassociation and volatilization, capacity to absorb oxidized impurities, and compatibility with the containment materials.

The flux is electrochemically such that it attracts base metal and other impurity oxides formed along the flux-molten layer interface, causing migration of the oxidized impurities in the molten material across the interface into the flux.

It is an essential factor of the invention to control the concentration of base metal oxides and other impurity oxides in the flux so that the electrochemical attraction of the flux for the impurity is sustained throughout the refining process. In one preferred method to accomplish this result, the flux for each given batch of molten material refined, is applied and removed in sequential increments or steps, the time period of each step being a function of concentration development in the flux (and correspondingly the concentration levels in the molten material) and the rate of change of concentration in the flux. After the flux application and a sufficient time to allow the base metal impurities and other impurities to be received into the flux, the flux is rabbled from the surface of the molten material, and another flux treatment applied to the surface. Note that during each sequential step in a particular batch, the concentration of pure metal remaining in the molten layer is also changed, and after each flux treatment the molten material obtains a higher purity level of precious metal. Applicants' have found that by the fourth incremental flux step, a highly pure precious metal (above 99.9%) is obtained. The flux, once removed from each incremental step, is not discarded, but is reused in subsequent batches in prior incremental steps all of which is described in greater detail below.

A post refining stage deals with the removal of any remaining dissolved oxygen in the highly purified silver material, since silver readily absorbs oxygen. This can be accomplished in a conventional manner such as in an argon environment or a vacuum chamber with the metal held in a carbon container. The material can then be cast into ingots or bars as desired.

In a preferred embodiment for increasing the economy of the overall process, batch techniques are employed so that several batches of silver-bearing materials can be processed, which allows the reapplication of flux used during the refining process in subsequent batches. By way of illustration, an example using five increments of flux is presented as follows:

| | Incr. 1 | Incr. 2 | Incr. 3 | Incr. 4 | Incr. 5 |
|---|---|---|---|---|---|
| Batch No. N | $I^2_{(N-1)}$ | $I^3_{(N-1)}$ | $I^4_{(N-1)}$ | $I^5_{(N-1)}$ | "New" |
| Batch No. (N + 1) | $I^2_N$ | $I^3_N$ | $I^4_N$ | $I^5_N$ | "New" |
| Batch No. (N + 2) | $I^2_{(N+1)}$ | $I^3_{(N+1)}$ | $I^4_{(N+1)}$ | $I^5_{(N+1)}$ | "New" |
| Batch No. (N + 3) | $I^2_{(N+2)}$ | $I^3_{(N+2)}$ | $I^4_{(N+2)}$ | $I^5_{(N+2)}$ | "New" |
| Batch No. (N + 4) | $I^2_{(N+3)}$ | $I^3_{(N+3)}$ | $I^4_{(N+3)}$ | $I^5_{(N+3)}$ | "New" |

For each batch of silver refined, five separate increments of flux are applied, removed, and saved. The first increment of flux applied to a batch is a flux increment that was used as the second application in a previous batch. Hence the notation $I_i^j$ describes a flux increment that was used as the j th application in the i th batch. The notation "New" refers to an increment of flux that has not been previously used for silver refining or has been treated to restore its full capacity for the absorption of the impure base metal oxides. The first flux increment applied to each batch (having previously been used as a second increment) after removal is not directly reused for silver refining. It may be processed for precious metal recovery in a separate processing step. Hence a given increment of flux is used first (new) as the fifth application step in the example shown, then in a subsequent batch as the fourth application step, and so on until it is used as the first application step. After its final use as the first increment application, it may be stored for processing through a separate metal recovery unit wherein valuable metal contents (precious metal) is extracted from the flux. When appropriate, the flux so treated may be returned to the silver refining operations as "New" flux. The sequential application of used flux from prior refining steps allows for additional base metal oxides to be received into the flux while as the base metal oxide content of the flux increases, some of the silver oxide remaining in the flux from the prior batch treatment will migrate back to the molten material as silver. Thus by the sequential usage of the flux increments, the amount of silver leaving the system in the exiting flux (i.e. the flux used in the first application) is kept at a small amount.

The Applicants have found that in the preferred method, the depth of the molten material bearing the silver or other precious metal is kept shallow to maintain good mixing and mass transfer conditions for the combined effects of the oxidizing agent and flux. This is not critical from the standpoint of the commercial application because the surface area, as determined by the length and width of the trays, may be made sufficiently large to provide a large volume output capability of the refining process.

EXAMPLE

An example of a specific experiment for the refining of crude silver into a purity in excess of 99.9% Ag is provided as follows:

For use in the experiment, a silver alloy charge was prepared having a composition of 90% Ag - 10% Cu by weight with a total liquid alloy weight of 9.767 pounds. The silver alloy was stabilized at about 1,040 degrees Celsius in a suitable shallow tray lined with stainless steel and a castable alumina refractory. One pound of prefused, dried and crushed flux was added to the molten alloy. (The prefused flux was previously prepared by melting together a mixture of 28.2 percent soda ash ($Na_2CO_3$), 32.8 percent silica ($SiO_2$) sand and 39.0 percent borax ($Na_2B_4O_7.10H_2O$) by weight. The loss of water of hydration from the borax and $CO_2$ from the soda ash, yielded a fused mixture equivalent to 27.1 percent $Na_2O$, 50.4 percent $SiO_2$, and 22.5 percent $B_2O_3$. After melting the above ingredients, the liquid fluxing agent was quenched into water, drained, and dried. The prefused and dried flux was crushed to minus-5 mesh particle size and separated into one pound lots for use in the refining experiment.)

After the one pound flux addition had melted, gaseous oxygen ($O_2$) was blown onto the surface of the bath for a period of about thirty minutes. The oxygen was introduced to the system through four stainless steel tubes. Each of the stainless steel tubes had a 0.055 inch diameter orifice in the end of the tube. During the oxygen blowing periods, the orifices of the four tubes were located about two inches above the liquid bath surface. Each of the four orifices were positioned near the centers of the four quadrants of the rectangular portion of the refining tray which contained the liquid metal. The oxygen flow rate through each orifice was about 0.25 SCF oxygen per minute per orifice. The four oxygen jets physically pushed the liquid flux away from the $O_2$ stream impingement points exposing the liquid surface of the metal in a zone about one to two inches in diameter.

After blowing oxygen onto the bath surface for about thirty minutes, oxygen blowing was stopped temporarily and the liquid flux, which covered the liquid metal bath, was removed from the refining tray by rabbling the flux up an inclined portion of the refining tray and out of the refining tray into a separate flux tray located in the furnace beneath the end lip of the refining tray. All of the flux recovered from the refining tray, was collected in a separate flux tray. After removal of the flux, a sample was removed from the metal bath to ascertain the extent of refining which had occurred. After sampling the metal bath, one pound of new flux was added to the metal surface and the above procedures were repeated. This refining sequence was repeated seven more times such that eight refining fluxes were introduced while oxygen was blown for eight distinct thirty minute periods and eight separate batches of flux were removed from the refining tray.

The temperature of the furnace was monitored throughout the refining. The temperature at the tray was maintained between 961 degrees and 1,050 degrees Celsius. The tray temperature was gradually reduced throughout the experimental period in order to promote improved refining capability.

The data obtained from the experiment are shown below in Table I:

TABLE I

SEQUENCE OF EXPERIMENTAL METAL ANALYSIS

| Sample No. | Time of Sampling | Copper % | Silver % |
|---|---|---|---|
| 1 | Initial Bath, 1:35 PM | 10.0 | 90.0 |
| — | (No Sample Taken On Removal of Flux #1) | | — |
| 2 | (after 2nd flux) 2:55 PM | 1.69 | 98.31 |
| 3 | (after 3rd flux) 3:39 PM | 0.45 | 99.55 |
| 4 | (after 4th flux) 4:17 PM | 0.14 | 99.86 |
| 5 | (after 5th flux) 5:00 PM | 0.06 | 99.94 |
| 6 | (after 6th flux) 5:45 PM | 0.02 | 99.98 |
| 7 | (after 7th flux) 6:30 PM | 0.01 | 99.99 |
| 8 | (after 8th flux) 7:18 PM | 0.01 | 99.99 |

Percent by weight on an oxygen-free basis.

Knowledge of the distribution of metal and the potential loss of metal within the various parts of the system is of major importance in any precious metal refining operation. Input-Output material balances for the experiment are given in Tables II and III, attached hereto.

TABLE II

EXPERIMENTAL INPUT/OUTPUT MATERIAL BALANCE

| ITEM | ITEM WEIGHT, POUNDS |
|---|---|
| INPUT | |
| Refining Tray (Empty) | 15.750 |
| Flux Tray 1 (Empty) | 4.469 |
| Flux Tray 2 (Empty) | 4.719 |
| Flux Tray 3 (Empty) | 4.469 |
| Flux Tray 4 (Empty) | 4.656 |
| Flux Tray 5 (Empty) | 4.438 |
| Flux Tray 6 (Empty) | 4.281 |
| Flux Tray 7 (Empty) | 4.813 |
| Flux Tray 8 (Empty) | 4.563 |
| Eight 1-pound batches of Flux | 8.000 |
| Crude Silver-Copper Ingot | 9.063 |
| Copper Turnings | 0.704 |
| Subtotal IN: | 69.925 |
| OUTPUT | |

TABLE II-continued

EXPERIMENTAL INPUT/OUTPUT MATERIAL BALANCE

| ITEM | ITEM WEIGHT, POUNDS | |
|---|---|---|
| Refining Tray + Heel | 16.500 | |
| Flux Tray 1 (with Flux) | 5.750 | |
| Flux Tray 2 (with Flux) | 6.281 | |
| Flux Tray 3 (with Flux) | 5.781 | |
| Flux Tray 4 (with Flux) | 5.719 | |
| Flux Tray 5 (with Flux) | 5.500 | |
| Flux Tray 6 (with Flux) | 5.281 | |
| Flux Tray 7 (with Flux) | 5.750 | |
| Flux Tray 8 (with Flux) | 5.688 | |
| Refined Silver Ingot | 7.031 | |
| Metal Samples | 0.168 | |
| Subtotal OUT: | 69.449 | (Loss: 0.476) |

The apparent loss included residual moisture, flux particles dispersed in furnace, and weighing errors.

TABLE III

SUMMARY OF METAL MASS BALANCES IN EXPERIMENT NUMBER EIGHT

| Item | Weight, Lbs. | Composition % Cu | Composition % Ag | Metal Weights, Lb. Cu | Metal Weights, Lb. Ag |
|---|---|---|---|---|---|
| INPUT | | | | | |
| Ag-Bearing Metal | 9.063 | 3.000 | 97.00 | 0.272 | 8.791 |
| Copper Turnings | 0.704 | 100.00 | 0.00 | 0.704 | 0.000 |
| Totals | 9.767 | — | — | 0.976 | 8.791 |
| OUTPUT | | | | | |
| Refined Ingot | 7.031 | 0.01 | 99.99 | 0.001 | 7.030 |
| Heel in Tray | 1.025 | 0.01 | 99.99 | 0.000 | 1.025 |
| Samples | 0.168 | 0.60 | 99.40 | 0.001 | 0.167 |
| Metal in Fluxes* | 1.413 | 63.13 | 36.87 | 0.892 | 0.521 |
| Totals | 9.637 | — | — | 0.894 | 8.743 |
| Unaccounted Metal | 0.130 | | | 0.082 | 0.048 |
| % Unaccounted | 1.33 | | | 8.40 | 0.55 |

*Includes both entrained metal and dissolved metal oxides. In this experiment, fresh (unused) flux was applied in eight separate increments. Hence, the flux carried more Ag than is the case when flux increments are reused in subsequent batches.

PRINCIPLES OF THE INVENTION

In the invention, several refining steps are used. In the preliminary or "roughing" step, crude silver or precious metal is melted and subjected to oxidizing conditions. The oxidation of impurities may be illustrated by Eq. 1.

$$2Cu+\tfrac{1}{2}O_2=Cu_2O \quad (1)$$

Here, we use copper for illustrative purposes only. The principles would apply to other base metal impurities. The thermodynamic properties and functions required to predict the extent to which Eq. 1 proceeds are available. For example, the Gibbs energy change of Eq. 1 is presented below.

| Temperature, °K. | $G^\circ_1$ Cal/g-mole |
|---|---|
| 1234 | −20,200 |
| 1300 | −19,100 |
| 1400 | −17,500 |
| 1500 | −15,600 |

The equilibrium constant, $K_1$, for Eq. 1 may be calculated by Eq. 2.

$$K_1=\exp(-\Delta G_1^\circ/RT) \quad (2)$$

In Eq. 2, $\Delta G_1^\circ$ is the Gibbs energy change of Eq. 1 in Calories/g-mole $Cu_2O$, R is the gas constant having a value of 1.987 Cal./g-mole °K., and T is the temperature in °K. Raoultian standard states are used for Cu and $Cu_2O$ and the usual unit fugacity standard state is applied to $O_2$. The activity of Cu, $A_{Cu}$, in a solvent may be calculated from the mass action expression given in Eq. 3.

$$\frac{A_{Cu2O}}{A_{Cu}^2 \cdot P_{O2}^{\frac{1}{2}}} = K_1 \quad (3)$$

Rearrangement of Eq. 3 yields Eq. 4.

$$A_{Cu} = K_1^{-\frac{1}{2}} \cdot A_{Cu2O}^{\frac{1}{2}} \cdot P_{O2}^{-\frac{1}{4}} \quad (4)$$

The activity of copper may be expressed as the product of concentration and activity coefficient, Eq. 5.

$$A_{Cu} = \mu_{Cu} \cdot X_{Cu} \quad (5)$$

In Eq. 5, $X_{Cu}$ is the atomic or molar fraction of copper in the solvent (silver in the present illustration). Now the combination of equations 2, 4, and 5 yields an expression for the equilibrium concentration of copper in a solvent contacted with a particular activity of cuprous oxide, $A_{Cu2}O$, a particular partial pressure of oxygen, $P_{O2}$ in atm., and at a particular temperature, T in °K.

$$X_{Cu} = \mu_{Cu}^{-1} \cdot \{\exp -\Delta G^\circ{}_1/3.974T\} \cdot A_{Cu2O}^{\frac{1}{2}} \cdot P_{O2}^{-\frac{1}{4}} \quad (6)$$

The values of $\Delta G_1°$ in Cal/g-mole $Cu_2O$ have been given at several temperatures. The value of $\mu_{Cu}$ in silver at 1423° K. is 3.406. This value is based on the Henryian constant of copper in the silver-copper binary. If oxygen is taken into account the values are reduced by the interaction between copper and oxygen, $Eo_{Cu}$. The values of $\mu_{Cu}$ at other temperatures are estimated by the application of regular solution theory to be as follows:

| | T (°K.) | | | |
|---|---|---|---|---|
| | 1234 | 1300 | 1400 | 1500 |
| $\mu_{Cu}$ | 4.11 | 3.83 | 3.48 | 3.20 |

While the precise values of $\mu_{Cu}$ may differ from those above, the errors are well within the limits required for the present illustration. The concentration of copper may be converted to a percentage by weight in silver in accordance with Eq. 7.

$$\% \text{ Cu} = \frac{63.5\, X_{Cu}}{1.079\,(1 - X_{Cu}) + 0.635\, X_{Cu}} \quad (7)$$

In Eq. 7, as well as in subsequent equations, the dissolved oxygen content of the silver has not been considered. The dissolved oxygen content is removed by carbon deoxidation after removal of base metal impurities in the oxidation-flux refining step. Also, we make use of the fact that the atomic weights of copper and silver are 63.5 and 107.9, respectively. For small values of $X_{Cu}$ (less than 0.05), we may use the following approximation with little error.

$$\% \text{ Cu} \approx 58.9\, X_{Cu} \quad (8)$$

Hence, the equilibrium copper content in silver expressed in percent by weight is given approximately by Eq. 9.

$$\% \text{ Cu} = 58.9 \cdot \mu_{Cu}^{-1} \cdot e^{-\Delta G^\circ 1/3.974T} \cdot A_{Cu2O}^{\frac{1}{2}} \cdot P_{O2}^{-\frac{1}{4}} \quad (9)$$

To illustrate the use of Eq. 9, consider the following case:

T=1234° K. for which $\Delta G_1° = -20{,}200$ and $\mu Cu = 4.11$ $A_{CU_2O} = 0.001$ $P_{O2} = 0.21$ atm.

Then, % Cu=0.011 which corresponds in the present illustration to %Ag=99.99. Higher values of temperature and $Cu_2O$ activity increase % Cu and decrease %Ag. Higher values of $P_{O2}$ decrease %Cu and increase %Ag. For example, if all other factors in the previous case are held constant but the temperature is increased to 1400° K., the equilibrium copper content is then 0.034 (%Ag=99.97). If all other factors in the last case are held constant but the $Cu_2O$ activity is increased to 0.01, then %Cu=0.108 (%Ag=99.89). If all other factors in the last case are held constant but the oxygen partial pressure is increased to 1.0 atm., % Cu=0.073 (%Ag=99.93). And finally, Eq. 9 predicts a 99.99% pure silver alloy (%Cu=0.011) with T=1400° K., $P_{O2}$=0.21 atm, and $A_{Cu2O}$=0.0001.

In the present invention, the $Cu_2O$ activity during the roughing or preliminary refining step has a value near unity. For T=1234° K., $A_{Cu2O}$=1, and $P_{O2}$=1 atm., it is found by Eq. 9 that % Cu=0.233, (%Ag=99.77). Hence, only under the most favorable conditions, can the action of oxygen alone yield silver with purity better than 99.5%.

In order to achieve a purity level of 99.9% or better the activity of $Cu_2O$ must be reduced substantially by absorption in a suitable flux. In the present invention, it is shown that silver with a purity of 99.99% can be obtained by appropriate combined action of oxygen and flux under conditions of good temperature control.

Some oxidation of silver can occur during the combined action of oxygen and flux. The equilibrium $Ag_2O$ content of the flux may be estimated from the following exchange reaction, Eq. 10.

$$2Ag + Cu_2O = Ag_2O + 2Cu \quad (10)$$

From $\Delta G_{10}°$, the equilibrium ratio of $Ag_2O$ to $Cu_2O$ in the flux may be estimated.

$$(Ag_2O)/(Cu_2O) \cong K_{10} A_{CU}^{-2} \quad (11)$$

The activity coefficients of $Ag_2O$ and $Cu_2O$ in the flux have been assumed to be equal in arriving at the following values of the $Ag_2O/Cu_2O$ ratio at 1234° K.

| % Ag | % Cu | Molar Ratio, $Ag_2O/Cu_2O$ |
|---|---|---|
| 97.00 | 3.00 | 0.00007 |
| 99.00 | 1.00 | 0.00063 |
| 99.50 | 0.50 | 0.00253 |
| 99.70 | 0.30 | 0.00708 |
| 99.90 | 0.10 | 0.0637 |
| 99.95 | 0.05 | 0.255 |
| 99.99 | 0.01 | 6.38 |

The values show that the $Ag_2O/Cu_2O$ ratio increases markedly with decreasing % Cu (increasing silver purity). Hence, the flux increments used at low copper content may contain significant amounts of $Ag_2O$ as well as entrained silver. For this reason it is highly desireable to reuse such flux increments in a subsequent batch in the manner set forth in the invention. The $Ag_2O$ (and entrained silver) may be returned to the melt by reversal of Eq. 10 at higher concentrations of Cu.

The principle of the combined action of oxidizing agents and fluxes may be described as follows. By contact of the impure silver melt with oxygen, air, or other oxidizing agent, oxygen enters the silver melt in monatomic form as shown in Eq. 12.

$$\tfrac{1}{2}O_2 = O \qquad (12)$$

The dissolved oxygen, O, then transfers (by mixing, forced and natural convection, diffusion) to the flux-metal interface face where it chemically combines with less noble metallic impurities such as copper which have similarly been transferred to the flux-metal interface. Although the interface reactions are complex, they may be represented by Eq. 13.

$$2Cu + O = Cu_2O \qquad (13)$$

It must be emphasized that it is not necessary for discrete particles of the impurity oxides to form. In fact, during the later stages of refining, the activity of $Cu_2O$ is very much less than unity. The impurity oxides then transfer to the flux wherein they remain in solution at an activity less than unity, Eq . 14.

$$Cu_2O = Cu_2O \text{ (dissolved in flux)} \qquad (14)$$

The dissolved oxide in the flux may undergo ionic dissociation to form ions of copper and oxygen, $Cu^+$ and $O^=$. Further ionic associations may result in the combination of $O^=$ ions with other anions to form complex anions and the ordering of $Cu^+$ ions within the complex anion networks.

Although all of the preceeding discussions have been illustrated with reference to the removal of copper, the same principles apply to the oxidation and fluxing of other impurities from molten silver.

In the preceeding sections mention has been made of suitable fluxes to be used in the refining of silver. In particular, suitable fluxes must possess the following characteristics:

- A melting or softening point below that of silver (961° C.);
- Good fluidity at temperatures just above the melting point of silver;
- Chemical stability; Resistance to dissociation and chemical deterioration; Low volatility;
- Capacity for the absorption of metal oxides formed by the refining of slver, e.g. the oxides of copper, iron, lead, etc.
- Compatability with materials of containment.

Fluxes containing boron oxide are particularly suitable. In fact, it has been demonstrated that a mixture of $B_2O_3$, $SiO_2$, and $Na_2O$ is an acceptable choice. However, many other choices may be made among mixtures containing $B_2O_3$ and it may be desirable to eliminate alkali metal oxides from the flux mixture in some cases. The ternary phase diagram (not shown) for the $B_2O_3$-$SiO_2$-$Na_2O$ system shows that mixtures within this system can be used as suitable fluxes. Such mixtures can be prepared from readily available raw materials. Another acceptable flux would be a boroaluminate flux. This flux would be made up largely from $B_2O_3$ with a small amount of $Al_2O_3$. Other ternary and more complex mixtures may be used in the current invention provided they meet the requirements previously stated.

The solubility of oxygen in silver is appreciable. At 1234° K., liquid silver in equilibrium with $O_2$ at one atmosphere pressure contains approximately 0.31% dissolved oxygen by weight. At higher temperatures, the solubility is slightly less. FIG. 1 (attached hereto) shows the equilibrium values of dissolved oxygen as a function of copper content in silver at several values of $Cu_2O$ activity and at 1234° K. It should be noted that the influence of dissolved oxygen on the activity coefficient of copper has been neglected. As before, copper is used for illustrative purposes only. Other base metals would exhibit similar characteristics.

Carbon is a strong deoxidizing agent for silver containing oxygen. The reaction given in Eq. 15 proceeds favorably in molten silver.

$$C + \tfrac{1}{2}O_2 = CO \text{ (gas)} \qquad (15)$$

For that reason, carbon is used as the deoxidizing agent for silver following the refining step. In this way, the dissolved oxygen can be reduced to values much less than 0.01%. Argon shrouding and impingement or vacuum applications may also be used.

Four nozzles were used in the demonstration to provide oxygen in excess of that required for the oxidation reactions. However, in the design of operating systems, the required number of nozzles, diameters, heights, and flow rates could be altered significantly. In selecting a flux for optimum compatability with refractory materials, it may be desireable to use a flux which contains the primary oxide of the refractory material. For example, a flux which is nearly saturated with $Al_2O_3$ may be used in conjunction with refining tray liners composed of alumina-base refractory.

FIG. 2 shows a schematic representation of the principles involved in the process with the molten material represented by "METAL" having base metal impurities copper, zinc, iron and lead. Oxygen impingement (shown as $O_2$) is absorbed at the surface of the molten metal allowing oxygen to be dissolved into the molten metal. The over-potential of oxygen at the molten material interface insures oxidation of the base metal impurities and other oxidizable impurities. The oxygen continuously coming into the solution is transported by diffusion and mixing to the interface of the flux and metal. By having a plurality of oxygen impingement points throughout the molten material, the establishment and maintenance of an over potential of oxygen along the interface throughout the molten material is ensured. As shown, the tendency for a given metallic solute to be transferred to the flux along the interface depends both upon the electro negativity of its cation and the bond energy between the cation and the reactive anion.

FIG. 3 shows the chemical reactions which include the introduction of oxygen into the molten silver metal at the gas metal interface and the metal-oxygen reaction mechanism at the flux metal interface. The order of oxidation of the metals shown ranges from zinc (Zn), iron (Fe), lead (Pb), copper (Cu) and finally silver (Ag). The Applicants have found that although some silver is entrained in the flux, the reuse of the flux at a prior sequential stage of a particular batch creates particular concentraton relationships of the base metal oxides relative to the remaining silver so that entrapped silver from the flux from the prior batch will more readily return to the metal, while at the same time getting the benefit of flux reuse. Thus, in the first and second stages of a particular batch, the overall purity of the remaining silver is less than in the terminal stages of the flux treatment. The reapplication and reuse of flux, however, does enhance the recovery of entrapped silver in the flux. FIG. 4 shows in a graphic representation the flow of the reused flux in subsequent batches, and its reintroduction in a preceding step. Also illustrated is an example of the relative copper and silver concentration in the flux in each stage of a particular batch.

The instant invention has been shown and described herein in what is considered to be the most practical and preferred embodiment. It is recognized, however, that departures may be made therefrom within the scope of the invention and that obvious modifications will occur to a person skilled in the art.

What we claim is:

1. A method for removing base metals, other oxidizable impurities, and volatile impurities from precious metal-bearing metallic material including gold or silver thereby producing a precious metal of high purity comprising the steps of:

(a) heating the precious metal-bearing metallic material to a molten state;

(b) controlling the temperature of the molten material to maintain the molten material in a molten state;

(c) incorporating an oxidizing agent in said molten material in a concentration sufficient to provide an amount of oxygen in the molten material to oxidize said base metals and other oxidizable impurities contained therein;

(d) introducing flux onto said molten material to form a liquid flux layer on said molten material;

(e) maintaining the concentration of oxygen in said molten material at the flux-metal interface while said flux layer is in contact with said molten material;

(f) establishing the molten metallic material and flux layer in a ratio sufficient to facilitate migration and absorption of said oxidized base metals and other oxidized impurities into said flux layer; and (g) maintaining the concentration of base metal and other impurity oxide in the flux layer at a level sufficient to allow oxidized base metal and oxidized impurities to continuously migrate from the molten material to the flux layer throughout the refining method.

2. The method as in claim 1, wherein the molten material is maintained in an oxidized state whenever the molten material is in contact with the flux layer.

3. The method as in claim 1, wherein a dissolved oxygen concentration is maintained in the molten material by establishing at least one stream of a gaseous oxidizing agent onto the surface of said molten material.

4. The method as in claim 1, wherein the temperature of the molten material is maintained slightly above the melt temperature of the molten material to be refined.

5. The method as in claim 1, wherein the step for maintaining a concentration of impurity oxides in the flux later below the level required to allow continued oxidation of base metals and oxidizable impurities include the steps of:

(g1) applying a first incremental amount of flux to said molten material;

(g2) removing said first incremental amount of flux from the surface of said molten material;

(g3) applying and removing sequentially one or more additional flux increments to and from said molten material to insure that the concentration of base metal oxides and impurity oxides in the flux stays below the level required to allow continued oxidation of base metals and oxidizable impurities from the molten material.

6. The method of refinement for multiple batches as in claim 1, including the steps of:

(h) reusing a particular removed flux increment in a subsequent batch in a prior sequential flux treatment step whereby entrapped precious metal in said flux will be recovered into said molten material.

7. The method as in claim 1, wherein the steps for controlling the temperature of the molten material to maintain the molten material in a molten state includes the step of:

(b1) controlling the temperature of the molten material to as low a practicable temperature as possible while still keeping the molten material in a molten state.

8. The method as in claim 1 wherein the flux contains soda ash, silica, and borax.

9. The method as in claim 1, wherein the molten material is disposed in a relatively shallow tray throughout the refining process.

10. The method as in claim 1, wherein the step of maintaining a concentration of dissolved oxygen in said molten material while said flux is in contact with said molten material includes the step of:

(e1) establishing the molten material in a proximal relationship with an array of gaseous oxidizing agent streams impinging upon the upper surface of the molten material, said array being disposed about the molten material whereby the gaseous oxidizing agent continuously impinges particular areas of the molten material to insure the maintenance of the concentration of dissolved oxygen in the molten material, especially at the flux-metal interface.

11. The method as in claim 1, wherein the step for maintaining a concentration of dissolved oxygen in the molten material while the flux is in contact with said molten material includes the steps of:

(1) maintaining a concentration of dissolved oxygen along the flux-metal interface in the molten material throughout the refining process.

12. A method as in claim 1, wherein the controlled temperature of the molten material does not substantially exceed 1090° C. in the refining of silver.

13. The method as in claim 1, including the steps of:

(h) oxidizing the precious-metal-bearing materials during meltdown;

(i) removing any resulting scum from the surface of said molten material resulting from the oxidation during meltdown prior to introducing the flux.

14. The method as in claim 5 in which the recovery of precious metal is greater than 98%.

15. The method as in claim 1 including removing flux from said flux layer in an amount sufficient to maintain the migration and absorbtion as recited in step (g) and thereafter refining said removed flux for the recovery of its metallic content.

16. The method as in claim 1 including the step of initially refining the precious metal-bearing material prior to the steps recited in claim 1.

17. The method as in claim 1 in which the oxidizing agent is added to the flux to create the necessary oxidation conditions at the flux-metal interface.

18. The method as in claim 1 in which the flux consists of a mixture of salts and oxides selected to have fluidity, stability, and potential for absorption of oxidized base metals and impurities.

19. The method as in claim 1 comprising refining the precious metal-bearing material in an oxide-containing refractory container and wherein the flux contains the oxides of the refractory container.

20. The method as in claim 5, wherein the molten metal and flux layers are moved countercurrently and fresh flux is added continuously or semicontinuously to the metal region wherein the refined metal is removed and the flux is removed continuously or semi-continuously at the region where the precious-metal-bearing material to be refined is added.

21. The method as in claim 1 wherein the molten precious-metal-bearing material and flux are agitated to increase the interfacial area between the two molten phases and to promote the delivery of oxidizing agent and base metals and other impurities to the flux-metal interface.

22. The method as in claim 5 wherein precious-metal-bearing materal is refined to a base metal and other impurity level less than 0.1% by weight in less than ten hours.

23. The method as in claim 1 in which the metal-bearing material contains impurities and base metals selected from Cu, Fe, Zn, Pb, As, Sb, Bi, Ni, Co, or S.

24. A method for refining N batches of precious metal bearing materials to enhance the recovery of precious metals in the refining process, each batch being refined by the application of several increments of flux comprising the steps of:

(a) heating N batches of precious-metal-bearing material to a molten state;

(b) introducing and maintaining an oxidizing agent in each molten batch;

(c) treating each batch with a series of flux treatment steps, wherein each step the molten material receives a flux application;

(d) removing the flux application from said molten material when each said flux increment has attained the effective limit of base metal and other impurity oxides;

(e) reusing the flux removed from a particular sequential step in one batch treatment in a subsequent batch treatment as an earlier sequential application step, to enhance recovery of the precious metal from the flux, thereby reducing the amount of precious metals unrecovered in the refining process.

* * * * *